United States Patent [19]

Weyde et al.

[11] 4,260,674

[45] Apr. 7, 1981

[54] SILVER SALT PHOTOGRAPHIC MATERIAL FOR THE PRODUCTION OF SILVER AND BUBBLE PHOTOGRAPHIC IMAGES WITH 80% TRANSPARENCY

[75] Inventors: Edith Weyde, Kuerten; Anita von König, Krefeld; Werner Liebe, Leverkusen, all of Fed. Rep. of Germany

[73] Assignee: Agfa-Gevaert Aktiengesellschaft, Leverkusen, Fed. Rep. of Germany

[21] Appl. No.: 103,442

[22] Filed: Dec. 14, 1979

Related U.S. Application Data

[63] Continuation of Ser. No. 862,628, Dec. 20, 1977, abandoned, which is a continuation-in-part of Ser. No. 568,603, Apr. 10, 1975, Pat. No. 4,065,312.

[30] Foreign Application Priority Data

Apr. 19, 1974 [DE] Fed. Rep. of Germany ..... 2418977

[51] Int. Cl.[3] ..... G03C 1/02; G03C 1/06

[52] U.S. Cl. ..... 430/271; 430/270; 430/290; 430/350; 430/353; 430/428; 430/429; 430/496; 430/567; 430/568; 430/617; 430/618; 430/619; 430/620; 430/943; 430/570; 430/641; 430/642

[58] Field of Search ..... 430/264, 270, 290, 350, 430/353, 496, 567, 568, 617, 618, 619, 620, 271, 428, 429, 570, 641, 642

[56] References Cited

U.S. PATENT DOCUMENTS

| | | | |
|---|---|---|---|
| 3,501,305 | 3/1970 | Illingsworth | 96/101 |
| 3,598,593 | 8/1971 | Klinger | 96/94 R |
| 3,615,491 | 10/1971 | Weyde | 96/50 R |
| 3,652,280 | 3/1972 | De Belder et al. | 96/94 R |
| 3,684,511 | 8/1972 | Weyde et al. | 96/48 HD |
| 3,694,207 | 9/1972 | Matejec et al. | 96/48 HD |
| 3,699,114 | 10/1972 | Ohkubo et al. | 96/114.1 |
| 3,705,033 | 12/1972 | Ranz et al. | 96/29 R |
| 3,706,566 | 12/1972 | Shiba et al. | 96/94 R |
| 3,736,144 | 5/1973 | Nagae et al. | 96/94 R |
| 3,751,249 | 8/1973 | Hiller | 96/114.1 |
| 3,765,890 | 10/1973 | Weyde et al. | 96/50 R |
| 3,776,730 | 12/1973 | Matejec et al. | 96/50 R |
| 3,801,326 | 4/1974 | Claes | 96/94 R |
| 3,816,133 | 6/1974 | Weyde et al. | 96/50 R |
| 3,917,485 | 11/1975 | Morgan | 96/94 R |
| 3,957,490 | 5/1976 | Libeer et al. | 96/94 R |

OTHER PUBLICATIONS

Florens, "Research Disclosure", 10/1973, pp. 44–46.

"The Focal Encyclopedia of Photography", vol. I., Focal Press, 1965, pp. 363–365.

Zelikman, U. L. et al., "Making and Coating Photographic Emulsions", Focal Press, 1964, pp. 131–138.

Evans, F. J., "Research Disclosure", 3/1977, pp. 47–48.

*Primary Examiner*—Charles L. Bowers, Jr.

*Attorney, Agent, or Firm*—Connolly & Hutz

[57] ABSTRACT

A photographic material for the production of an image in a dry process by forming a vesicle image upon the decomposition of a peroxide compound at image nuclei of silver by providing a layer containing a silver salt which forms upon exposure to light, in imagewise distribution, image nuclei. The silver salt has a grain size of less than 0.3 μm and is present in the layer in an amount of from 1–500 mg/m$^2$.

20 Claims, No Drawings

SILVER SALT PHOTOGRAPHIC MATERIAL FOR THE PRODUCTION OF SILVER AND BUBBLE PHOTOGRAPHIC IMAGES WITH 80% TRANSPARENCY

CROSS-REFERENCE TO PARENT APPLICATION

This application is a continuation of pending application Ser. No. 862,628 filed Dec. 20, 1977 for *Photographic Material For The Production Of Photographic Images,* now abandoned, which application is a continuation in part of U.S. application Ser. No. 568,603 filed Apr. 10, 1975 by Edith Weyde et al for *Process For The Production Of Photographic Images* (now U.S. Pat. No. 4,065,312, issued Dec. 27, 1977).

This invention relates to a photographic material for dry production of photographic images in which a substantially transparent layer containing a light-sensitive silver salt is imagewise exposed and then peroxide compounds are decomposed on the image nuclei which are formed on exposure. The image being rendered visible either physically by development of the gas bubbles produced by decomposition or chemically by making use of the oxygen produced on decomposition for a colour producing oxidation reaction.

Prior transparent photographic materials are known, but these materials lack characteristics and qualities which are important to the above-mentioned dry production of images. In one such previously known material has a light sensitive layer of silver halide with grains of less than 0.3 μm in size the silver salt concentration is 3 g/m$^2$ or higher and the layer is cast from an emulsion having a pAg value above equivalence. Such prior known material is unsatisfactory in the dry production of images according to the present invention.

The production of photographic images by the imagewise production of compounds which form gas bubbles, in particular hydrogen peroxide, is also already known. U.S. Pat. No. 3,615,491 describes a process for the production of a photographic image which comprises a silver image and a bubble image superimposed on the silver image.

In the said process, a silver image is first produced in the conventional manner in a hydrophilic layer, but this image has substantially less covering power than conventionally produced black-and-white images. The layer is then brought into contact with hydrogen peroxide which decomposes to form oxygen bubbles in the image areas which contain the silver in a finely divided form. When the exposed material is subsequently heated, the gas liberated expands and a bubble image is formed. Since these bubbles scatter the light image, the areas containing them appear dark through transmitted light but light on a dark background when viewed by reflected light. Most of the incident light passes through the unexposed areas of the layer. The silver image is thereby very powerfully reinforced and deep black images, with high contrast when viewed by transmitted light, are obtained with layers which have a very low silver content. The photographic images obtained by this process have an excellent quality.

It is also known that the oxygen produced by imagewise destruction of hydrogen peroxide can be rendered visible not only by the physical method of forming gas bubbles as described above but also by a chemical method utilizing a colour forming oxidation reaction. In this process, a light-sensitive layer is exposed to light so that nuclei of noble metals of sub-Groups I and VIII of the Periodic System are produced imagewise and the layer is then treated with peroxy compounds in the presence of reactants for a colour forming oxidation reaction, the peroxy compounds undergoing catalytic decomposition on the nuclei which have been formed imagewise.

The processes mentioned above result in photographic images of good quality but they have the disadvantage of requiring wet processing with aqueous baths or at least in the presence of a relatively high residual moisture content in the layer.

It is among the objects of this invention to modify the above processes or the photographic materials required for these processes so that photographic images can be obtained by a dry process.

A photographic material for dry production of photographic images by imagewise exposure of a self-supporting light-sensitive layer or a supported layer has now been found in which light-sensitive silver salts are dispersed, which salts form catalysts for the decomposition of peroxide compounds when exposed to light, the exposed layer being subsequently treated with a peroxide compound to form a visible image, the light-sensitive layer containing the silver salt in quantities of 1 to 500 mg/m$^2$, the silver salt dispersion having a pAg value below the equivalence point before the emulsion is cast, the grain size of the silver salt grains being less than 0.3 μm and the transparency of the photographic material being at least 80%.

The light-sensitive layers according to the invention have a relatively low silver content of 1 to 500 mg, preferably 100 to 300 mg/m$^2$ and the thickness of the layer is 2 to 15 μm, preferably 5 to 10 μm.

The silver salt dispersions used for the preparation of the layer according to the invention should have a pAg value below the equivalence point before casting. This means that the silver salts are prepared with an excess of silver ions amounting to 1 to 50 mols%, preferably 20 to 40 mols%, although the excess of silver ions may be smaller towards the end of precipitation.

Based on the precipitation of the silver salts in the aqueous medium, this means that the pAg value should be less than 6. pAg values of between 3 and 6 are preferred. The grain size of the silver salt grains in the light-sensitive layers of the material according to the invention is relatively small and should be less than 0.3, preferably less than 0.1, μm. Silver salt dispersions with a relatively narrow grain size distribution and the maximum at about 0.05 μm are particularly suitable.

The transparency of the materials according to the invention should be at least 80%. This means that the material according to the invention should not absorb more than 20% of visible light, taking as reference value the transparency of a sheet of the same structure and same composition but not containing silver salts or any other additives.

The transparency of at least 80% is significant because in a fine-grained emulsion having a thickness of from 2 to 15 um a reduction of transparency to less than 80% is detectable visually.

It will be seen that in the advance of this invention, the photographic material from the above-described preparation of fine-grained light sensitive layer with relatively low silver content from an emulsion with an excess of silver ions, has as a measure or mark of the photographic material that the emulsion from which the light-sensitive layer is cast has a pAg value below the equivalence point.

The known transparent supports used for photographic materials are suitable for the material according to the invention. These include e.g. foils of cellulose esters, polyesters based on polyethylene terephthalic acid esters or polycarbonates, particularly those based on bisphenol A. When choosing a suitable support layer it is of course necessary to ensure that it will be stable at the processing temperature.

Suitable light-sensitive silver salts for the material according to the invention are e.g. silver halides such as silver chloride, silver bromide or mixtures thereof, which may have a silver iodide content of preferably up to 10%. If desired, pure silver iodide may also be used as light-sensitive substance for the material according to the invention. Silver halides are preferred on account of their relatively high natural light sensitivity although the silver halide may be partially or totally replaced by other silver salts, e.g. silver salts of organic carboxylic acid, in particular of long chain carboxylic acids, or silver salts of thioether-substituted aliphatic carboxylic acids as described in U.S. Pat. No. 3,330,663. Silver salts of polybasic aliphatic carboxylic acids such as silver oxalate, silver salts of inorganic acids such as silver phosphate or silver salts of organic compounds, in particular silver salts of sensitizing dyes as described in U.S. Pat. No. 3,446,619 are also suitable.

The silver salt dispersion used according to the invention are prepared in known manner, for example by double inflow of the precipitation components, that is to say a solution of a soluble silver salt and a solution of a salt of the anion used for precipitation of the light-sensitive silver salt. Care must be taken to ensure that an excess of silver ions is present during precipitation. Alternatively, the solution of a silver salt may be introduced into a reaction vessel and to this may be added the solution of a salt of the anion of a less soluble silver salt which is thereby precipitated. When this method is employed, an excess of silver ion is present during precipitation of the light-sensitive silver salt. If the converse procedure is adopted and the pAg value is lowered only towards the end of the precipitation due to an excess of silver salts, the layers obtained would still be usable but their sensitivity is distinctly lower. The conditions customary for the so called silver digestion technique is carried out at slightly elevated temperatures of about 50° C. and optionally elevated pH values of between 6 and 8. The silver concentration is raised, i.e. a relatively low pAg value of between about 3 and 6 and preferably about 3 is employed.

The precipitation of the light-sensitive silver salts is preferably carried out in the presence of the binder for the light-sensitive layer. The binders used may be natural or synthetic hydrophilic or hydrophobic film forming polymers. Proteins such as gelatine, particularly photographically inert gelatine, cellulose derivatives such as cellulose esters or ethers, e.g. cellulose sulphate, carboxymethyl cellulose or cellulose acetates, particularly cellulose acetates with a degree of acetylation of up to 2, and synthetic polymers such as polyvinyl alcohols, partially saponified polyvinyl esters, e.g. partially saponified polyvinyl acetate and polyvinyl pyrrolidone are suitable. The above binders may be used alone or as mixtures.

The material according to the invention and the process for producing photographic images differ fundamentally from the known processes for the production of photographic images by the imagewise decomposition of peroxide compounds carried out as described above.

Whereas in the known processes the decomposition of peroxide compounds takes place on relatively coarse nuclei of metallic silver which have been formed after exposure and photographic development, in the present invention the decomposition of peroxide compounds is catalysed by very much finer silver, namely by the image nuclei produced on exposure to light. The process for the production of the photographic images is thereby considerably simplified. That image nuclei were sufficient for producing photographic images by the decomposition of peroxide compounds or, in other words, that the process according to the invention would operate at all, was particularly unexpected in view of the well known sensitivity of latent image nuclei to oxygen, which would lead one to assume that the peroxide compound would destroy the latent image nuclei by oxidation before these nuclei could act as catalysts for the decomposition of a peroxide compound. This assumption is in fact quite correct for photographic materials with a conventional structure. In such materials it is not possible to decompose peroxide compounds on the latent image nuclei to a sufficient extent because the nuclei are first oxidized.

It is only by means of the special composition of the material according to the invention that sufficient stability of the image nuclei is obtained to make it possible for the peroxide compound to be decomposed and hence the latent image to be rendered visible. Destruction of the image nuclei by oxidation is not of course, completely suppressed by the special composition of the material according to the invention.

It is however, possible, to increase the stability of the image nuclei even further by certain measures or additives and hence considerably improve the light-sensitivity of the photographic materials. The light-sensitivity of the material according to the invention is improved by exposing the material to a heat treatment before, during or after exposure. This can be done simply by heating the material to temperatures of between 80° and 130° C. The time of heating may vary within wide limits and depends on the composition of the photographic material. Heating times of between 2 and 30 seconds are generally effective. The heat treatment substantially reduces the residual moisture content of the layers in which the light sensitive silver salts are dispersed. This applies particularly to hydrophilic layers which have a relatively high residual moisture content. Since moisture favours the destruction of the image nuclei by peroxide compounds, the positive effect of the heat treatment is presumably due to this reduction in moisture content.

The stability and hence the light-sensitivity of the materials according to the invention can be further improved by certain additives. These stabilizing compounds cannot be chemically classified. Those compounds which may be expected to act as halogen acceptors are generally suitable. The positive effect of such compounds is due to the fact that they bind the halogen produced in the primary action during latent image formation when the materials are exposed to light. Destruction of the silver latent image nuclei by the halogen is thereby suppressed. The concentration of the stabilizing additives can be varied within wide limits, depending on the activity of stabilizing ingredient and the effect desired.

Concentration ranges which are generally sufficient are referred to below.

The following silver salts are examples of suitable stabilizing compounds:

Silver oxalate,
Silver phosphate,
Silver-(3-carboxylatomethylthio)-1,2,3-triazole,
Silver-(3-carboxylatomethylthio)-5-amino-1,2,4-triazole,
Silver-(2-carboxylatomethylthio)-5-amino-1,3,4-thiadiazole,
Silver-(2-carboxylatomethylthio)-5-anilino-1,3,4-thiadiazole,
Silver-(2-carboxylatomethylthio)-benzimidazole,
Disilver-[3,5-bis-(carboxylatomethylthio)]-1,2,4-triazole,
N-(N-tosyl-N'-phenylurea)-silver,
N-(N-3-amino-4-hydroxybenzenesulphonyl-N-benzenesulphonimide)-silver,
N-(1,2-benzisothiazolyl)-3-one)-silver,
Silver-(2-carboxymethylthio-4-methyl)-quinoline,
Disilver-(1,2-bis-carboxylatomethylthio)-ethane,
N-benzotriazolyl-silver, a silver salt of the compound:

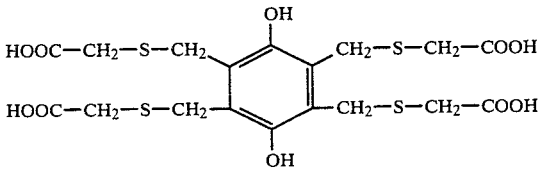

silver salts of the dyes

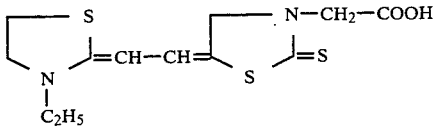

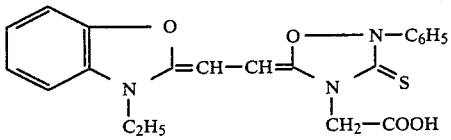

The stabilizing silver salts are added in amounts of between 5–10 mol % based on the amount of the light-sensitive silver salt.

Reducing agents such as hydrazines and their derivatives, substituted hydrazines, acylated hydrazines, in particular hydrazides as well as aminophenols, amino-substituted benzene compounds, particularly phenyldiamine and substitution products thereof, e.g. the following, also have a stabilizing effect and hence improve the light sensitivity:

Hydrazides
- Tartaric acid dihydrazide
- malonic acid dihydrazide
- malic acid dihydrazide
- mucic acid dihydrazide
- citric acid trihydrazide Concentrations of the stabilizing hydrazides of 0.5–0.75 g/kg of the silver salt dispersion have proved sufficient.

Polyamines
- Diethylene triamine

The polyamines are preferably applied in concentrations of 0.5–1.5 preferably around 1 g/kg of the silver salt dispersion.

Hydroxylamine derivatives
- N-ethyl-N'-hydroxyurea
- N-phenyl-N'-hydroxyurea
- N-hydroxyurea
- N-hydroxybenzamide
- N-hydroxy-carbamic acid ethyl ester The hydroxylamines are preferably added in concentrations of 0.5–1 g/kg of the silver salt dispersion.

Phenols
- Pyrocatechol
- hydroquinone
- 2-(1-phenyl-5-tetrazolylthio)-hydroquinone or similar compounds which are described in U.S. Pat. No. 3,379,529;
- 1,4-dihydroxyphthalimide
- DL-d-methyl-β-(3,4-dihydroxyphenylalanine)
- homogentisic acid
- homogentisic acid amide The phenols show sufficient stabilizing effect if added in quantities of preferably between 0.3–1.5 g/kg of the silver salt dispersion.

Phenylenediamines
- N,N-diethyl-N'-sulphomethyl-p-phenylenediamine
- N,N-dimethyl-N'-sulphomethyl-p-phenylenediamine
- 3-methyl-4-sulphomethylamino-N,N-diethylaniline The phenylenediamine stabilizers are added in amounts of 0.5–2.5 g, preferably 2 g/kg of silver salt dispersion.

Heterocyclic compounds

In particular useful are triazole compounds, for example the following:
- 3-mercapto-4(p-sulphophenylamino)-5-methyl-1,2,4-triazole
- 3-mercapto-4(p-sulphophenylamino)-5-benzyl-1,2,4-triazole
- 3-mercapto-4-phenyl-5-anilino-1,2,4-triazole
- 3-mercapto-4-acetamido-1,2,4-triazole
- 3-mercapto-4-amino-1,2,4-triazole
- Benzotriazole.

The above stabilizing compounds are known per se and can be prepared according to methods well known in the art. The preparation of the 3-mercapto-4-amino-1,2,4-triazoles is performed by condensation of thiocarbohydrazide or its derivatives with o-formic acid esters or imino ethers. The method of making one of these compounds is described in the following in detail:

3-mercapto-4(p-sulphophenylamino)-5-methyl-1,2,4-triazole:
- 5,6 g of N-p-sulphophenyl-thiocarbohydrazide are dissolved in
- 50 ml of dry methanol which contains 1/50 mol of $NH_3$.

2.4 g of acetoimino ether are added and the solution is heated under reflux. The precipitating crystals are suction-filtered and recrystallized from water (Mp 291° C. under decomposition). N-p-sulphophenyl-thiocarbohydrazide is prepared by dissolving 205 g of the ammonium salt of phenylhydrazine p-sulphonic acid in a mixture of 400 ml of water, 200 ml of ethyl alcohol and 40 g of sodium hydroxide and dropwise addition to that mixture of 80 g carbon disulphide at 40° C. After addition it is shortly heated to a temperature of 50° C. and cooled. Thereafter 126 g of dimethylsulphate are added while carefully cooling. After the reaction is finished, the alcohol is evaporated in vacuum and gaseous hydrogen chloride is introduced until the sodium chloride thus formed is precipitated.

It is suction-filtered, saturated with gaseous hydrogen chloride and cooled. The precipitating methyl ester is suction-filtered and recrystallized from concentrated aqueous hydrochloric acid. 295 g of that product is dissolved in 300 ml of ethyl alcohol at 40°-50° C. and mixed while stirring with 150 ml of 91% aqueous hydrazine hydrate.

With continuation of the exothermic reaction two liquid layers are formed. It is further heated for one hour to a temperature of 60° C., mixed with 2 liter of water and neutralized with hydrochloric acid. The precipitating compound is suction-filtered and recrystallized several times from water (Mp 195°-200° C. under decomposition).

The above compounds are added to the photographic layer before it is cast. Their concentration may vary within wide limits and depends on the effectiveness of the compound and the purpose for which it is required. It has generally been found advantageous to use concentrations of from 10 to 500 mg, preferably from 50 to 200 mg per liter of casting solution, which corresponds to a concentration of 10 to 200 mg/m$^2$ of material.

The above compounds which improve the stability and light-sensitivity may also be used as mixtures with each other. Optimum combinations can easily be found by simple laboratory tests.

The materials according to the invention can be improved in their storage stability by the addition of known antioxidants such als alkali metal sulphite, bisulphite addition products of aldehydes and ketones, preferably cycloalkyl ketones, particularly cyclohexanone bisulphite.

The silver salt dispersion may also be chemically sensitized, e.g. with reducing agents such as tin-II salts, polyamines such as ethylene triamine and sulphur compounds as described in U.S. Pat. No. 1,574,944 or in the book by NEES entitled "Theory of the Photographic Process" (1954), pages 149-161. Salts of noble metals such as ruthenium, rhodium, palladium, iridium, platinum or gold may also be used for chemically sensitizing the given emulsions, as described in the article by R. KOSLOWSKY, Z.Wiss.Phot. 46, (1951), pages 65-72. Compounds of the thiomorpholine series, e.g. those described in French Patent Specification No. 1,506,230 and polyalkylene oxides, particularly polyethylene oxide and derivatives thereof are also suitable for this purpose.

The silver salt dispersions may also be optically sensitized, e.g. with the usual polymethine dyes such as neutrocyanines, basic or acid carbocyanines, merocyanines or rhodacyanines, hemicyanines, styryl dyes and oxonols. Sensitizers of this kind have been described in the book by F. M. HAMER, "The Cyanine Dyes and Related Compounds," Interscience Publishers, a division of John Wiley and Sons, New York (1964).

If hardenable binders are used for the dispersion of silver salts, they may be hardened in the usual manner, for example with formaldehyde or halogenated aldehydes which contain a carboxyl group such as mucobromid acid, diketones, methanesulphonic acid esters and dialdehydes.

The method employed for processing the materials according to the invention to produce a photographic images is basically already known. It comprises two main steps, namely the imagewise exposure of the light-sensitive material, optionally with heating, before, during or after exposure as described above, and treatment of the exposed material with peroxide compounds. This is done most simply by bringing the exposed layer into contact with vapours of a peroxide compound with heating. Hydrogen peroxide or compounds which liberate hydrogen peroxide when heated are the most suitable for this purpose.

According to a preferred embodiment of the process, the exposed layer is brought into contact with a sheet of material which contains hydrogen peroxide or addition products thereof. It is then heated in contact with this material so that hydrogen peroxide is transferred from the carrier layer into the exposed silver salt dispersion layer. A bubble image is thereby produced in the silver salt dispersion layer, or if this layer contains reactants for an oxidation reaction to produce dyes, a visible dye image is produced.

These two possible methods of producing visible images by imagewise decomposition of peroxide compounds have been described in U.S. Pat. Nos. 3,615,491 and 3,674,490.

Peroxide containing layers which are used for the preferred embodiment of the process indicated above have been described in U.S. Pat. No. 3,765,890.

The materials according to the invention are exceptionally advantageous in numerous respects. Firstly, photographic images of high density are produced with a minimum silver content which is many times less than that required for producing conventional photographic images. A considerable saving in the quantity of silver used is thereby achieved, which is of the utmost practical importance in view of the increasing shortage of silver.

Furthermore, the photographic materials according to the invention are distinguished by the fact that they are practically free from fogging problems. Whereas in conventional photographic materials and with the usual methods of processing by photographic development of the exposed material it is important to suppress the uniform, spontaneously developable fog in the unexposed material as far as possible, processing the material according to the invention does not give rise to a uniform fog of a density which would make conventional photographic materials unusualbe. Preparation of the photographic material according to the invention is therefore much simpler and less expensive. The materials according to the invention result in photographic images of relatively steep gradation and they are therefore particularly suitable for use as copying films, particularly as micro-films for archive purposes. They can also be used for numerous other purposes and they are also particularly suitable e.g. for many uses in computers. The sensitivity of the materials according to the invention is substantially higher than that of comparable copying materials, e.g. those operating by the so-called Kalvar principle.

EXAMPLE 1

Preparation of the light-sensitive layer:

A mixture of 250 ml of a 10% aqueous solution of inert gelatine and 50 ml of a 2% aqueous solution of silver nitrate was introduced into a reaction vessel and 10 ml of a 5% aqueous solution of potassium bromide were added dropwise. The emulsion was solidified in the usual manner. It had a pAg of 3.74. The silver bromide grains had an average grain diameter of 0.015 $\mu$m.

2.5 ml of a 30% aqueous solution of saponin were added before the emulsion was cast. The emulsion was applied to a support of cellulose triacetate to yield a silver concentration of 0.3 g in the form of silver halide per $m^2$. After drying at 40° C., the photographic material had a transparency of 90%. It was exposed to light and then heated to 100° C. on a heating press for about 5 seconds. The heat treated film was then brought into close contact with a foil containing hydrogen peroxide and heated to a temperature of about 100° C., e.g. in a heating press, while in contact with the foil.

The foil was obtained by coating a cellulose acetate film with a solution of polyvinyl alcohol or carboxymethyl cellulose with the addition of hydrogen peroxide. It contained about 2 to 6 g of hydrogen peroxide $m^2$.

A sharp bubble image with very fine bubbles was obtained from which very good copies can be produced.

EXAMPLE 2

Preparation of the light-sensitive layer 430 ml of a 7% aqueous solution of the sodium salt of cellulose sulphate containing 2 to 3 sulphate groups per glucose unit (e.g. the product marketed by Kelco under the Trade Name KELCO SCS/LV) and 300 ml of a 7% aqueous solution of inert gelatine were introduced into a reaction vessel and the pH of the mixture was adjusted to 6.5.

20 ml of an 8.75% aqueous solution of silver nitrate were then added and finally 20 ml of a 5.5% aqueous solution of potassium bromide were introduced dropwise. The emulsion was further processed in the usual manner. Before casting 5 ml of a 30% aqueous solution of saponin were added.

The photographic emulsion described above had a pAg of 4.5 and an average grain diameter of 0.05 μm. It was cast on a support of cellulose triacetate to form a layer containing 0.3 g of silver in the form of silver halide per $m^2$.

The light-sensitive material had a transparency of 80% after drying. Processing was accomplished as described in Example 1. The sensitivity obtained is 10 times higher than in Example 1.

EXAMPLE 3

50 ml of a 2% aqueous solution of pyrocatechol were added to the emulsion of Example 2 before casting. The emulsion was then processed as described in Example 2. The sensitivity was increased by a factor of 10 to 100 compared with that obtained in Example 2.

Similar increases in sensitivity were obtained when pyrocatechol was replaced by one of the reducing agents:

- 0.4 g malonic acid hydrazide
- 0.6 g citric acid hydrazide
- 0.5 g mucic acid hydrazide
- 1.5 g N,N-diethyl-N'-sulphomethyl-phenylenediamine
- 0.58 g N-ethyl-N'-hydroxyurea
- 0.77 g diethylentriamine
- 0.38 g 2-(1-phenyl-5-tetrazolylthio)-hydroquinone Compounds of the last mentioned type further improve the stability of the white non-image areas of the final image.

EXAMPLE 4

Preparation of the light-sensitive layer

The same mixture of cellulose sulphate, inert gelatine and silver nitrate solution as in Example 2 was introduced into a reaction vessel. A mixture of 18 ml of a 5.5% solution of potassium bromide and 2.2 ml of a 5.5% solution of potassium iodide was added dropwise and the emulsion was processed in the usual manner.

5 ml of a 30% aqueous solution of saponin and 30 ml of a 3% dispersion of silver oxalate in a 7% aqueous solution of cellulose sulphate and inert gelatine (proportion by weight 1:1) were added to the emulsion before casting.

The photographic emulsion described above had a pAg of 4.5 and the silver halide grains had a grain diameter of 0.05 μm.

The emulsion was applied on a support of cellulose acetate in the usual manner to form a layer containing 0.2 g of silver in the form of silver halide per $m^2$. The material finally obtained had a transparency of about 80% after drying. It has further processed as described in Example 1. The sensitivity measured was higher by the factor 10 than of the material of Example 2.

Similar results were obtained when the silver oxalate was replaced by other silver salts of the type described above. The optimum concentration and type of emulsion can be determined by a few simple tests.

Excellent results are obtained, for example, if the above silver oxalate dispersion is replaced by 30 ml of a 2.5% dispersion of silver-(3-carboxylatomethylthio)-1,2,4-triazole or 30 ml of a 4% dispersion of disilver-(3,5-biscarboxylatomethylthio)-1,2,4-triazole.

EXAMPLE 5

A photographic emulsion was prepared as described in Example 3. 7.5 ml of a 0.1% methanolic solution of sensitizing dye of the following formula

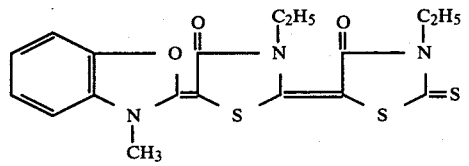

were added before the emulsion was cast. Preparation of the above dye is described in British Patent Specification No. 489,335.

A sensitivity increase by a factor of about 100 compared with the sensitivity of the material of Example 3 was obtained.

The above sensitizing dye can be replaced by other sensitizing dyes generally applied for sensitizing photographic layers such as

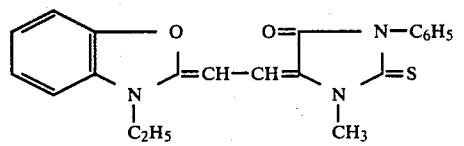

-continued

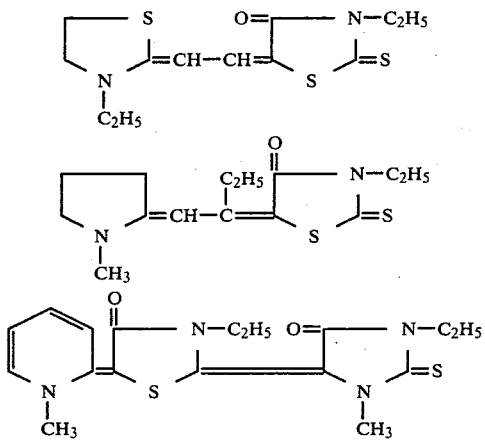

EXAMPLE 6

Preparation of the light-sensitive layer 100 ml of an 8% solution of cellulose acetate (degree of acetylation 1.75) in acetone/water (proportion by weight 4:1), 100 ml of methyl glycol, 62 ml of water and 7.5 ml of a 4% aqueous solution of silver nitrate were introduced into a reaction vessel and 5.2 ml of a 3% aqueous solution of potassium bromide were added.

The photographic emulsion described above was cast on a support of cellulose acetate (thickness 200 μm) to produce a layer containing 0.2 g of silver in the form of silver halide per $m^2$. The transparency was about 90% and the average particle size about 0.025 μm.

Processing

The material was treated with hydrazine vapours for 0.5 to 1 minutes. After imagewise exposure the exposed material was brought into contact with a foil containing hydrogen peroxide as described in Example 1 and heated. A very sharp bubble image was obtained. To facilitate formation of the bubble image, the operation of heating in contact with the foil which contains hydrogen peroxide was carried out at a slightly higher temperature, i.e. about 120° C.

The bubble image obtained is stable to high moisture contents in the air and to water.

EXAMPLE 7

Preparation of the light-sensitive layer

To 1 liter of a 10% aqueous solution of inert gelatine are added:

20 ml of a 17.5% aqueous solution of silver nitrate 20 ml of a 10% aqueous solution of potassium bromide 6 ml of a 1% aqueous solution of 3-mercapto-4(p-sulphophenylamino)-5-phenyl-1,2,4-triazole.

The above silver salt dispersion is solidified, noodled and washed with water until the wash water is free from nitrate ions.

82 g of the above solid emulsion is melted and added to the following mixture of binding agents:

200 ml of a 7.5% aqueous solution of sodium cellulose sulphate (containing 2–3 sulphate groups per glucose unit, for example the product KELCO SCS/LV of Kelco Ca. San Diego, USA)

125 ml of a 6.4% aqueous solution of inert gelatine.

The pH value of the mixture was adjusted to 6.5.

After addition of a wetting agent, for example sodium lauryl sulphate, the above mixture is applied onto a subbed cellulose acetate support and dried. The final layer had a thickness of 10 μm and a silver concentration of 0.15 g of silver in the form of silver bromide per quare meter.

The transparency was 95%.

Processing

The photographic processing was accomplished as described in Example 1.

It is a characteristic advantage of the photographic material of this invention that relative sharpness and density is obtained. This characteristic of the sharper, denser image is related to the greater relative transparency of the film layer of the present invention.

What is claimed is:

1. A photographic material for the production of photographic images for imagewise exposure comprising a selfsupporting or supported light-sensitive layer containing a light-sensitive silver salt emulsion having a thickness of from 5 to 15 μm and having the silver salt in an amount of from 1 to 500 mg/$m^2$ and cast from an emulsion having silver salt with a 1 to 50 mol % excess of silver ions and a pAg value below the equivalence point, capable of forming on exposure image nuclei of silver in catalytic amounts that cause development of an image of fine bubbles when the exposed layer is treated with a peroxide compound in a dry state, the silver grains of said silver salt having a grain size of less than 0.3 μm and the transparency of the layer being at least 80%.

2. A material as claimed in claim 1 in which the light-sensitive layer contains the silver salt in a quantity of from 100 to 300 mg/$m^2$.

3. A material as claimed in claim 2 in which the silver salt emulsion layer has a thickness of from 5 to 10 μm.

4. A material as claimed in claim 3 in which the silver salt has a 20 to 40 mols-% excess of silver ions.

5. A material as claimed in claim 1 in which the silver salt emulsion has a pAg value below 6.

6. A material as claimed in claim 5 in which the dispersion has a pAg value of from 3 to 6.

7. A material as claimed in claim 1 in which the grain size of the silver grains is less than 0.1 μm.

8. A material as claimed in claim 7 in which the silver salt dispersion has a narrow grain size distribution with a maximum at 0.05 μm.

9. A material as claimed in claim 1 in which a support for the layer is a cellulose ester, polyethylene terephthalate acid ester or polycarbonate foil.

10. A material as claimed in claim 1 in which the light-sensitive silver salt is a silver halide.

11. A material as claimed in claim 1 in which the light-sensitive silver salt is a silver salt of an organic carboxylic acid.

12. A material as claimed in claim 11 in which the light-sensitive silver salt is the silver salt of a thioether-substituted aliphatic carboxylic acid.

13. A material as claimed in claim 1 in which the light-sensitive layer or an adjacent layer contains a reducing agent.

14. A material as claimed in claim 13 in which the reducing agent is an agent selected from the group consisting of hydrazine, hydrazine derivative, substituted hydrazine, acylated hydrazine, hydrazide, aminophenol amino substituted benzene, hydroxyurea, 1,2,4-triazole, homogentisic acid, compounds and procatechol, hydroquinones, 1,4 dihydroxyphthalimide, DL-d-methyl-B-(3,4-dihydroxyphenyl alamine) and benzotriazole.

15. A material as claimed in claim 13 in which the reducing agent is present in a concentration of from 10 to 500 mg per liter of the casting emulsion.

16. A material as claimed in claim 15 in which the reducing agent is present in a concentration of from 50 to 200 mg per liter of the casting emulsion.

17. A material as claimed in claim 1 which contains a silver salt or complex of a sensitizing dye having at least one $$-\overset{|}{\underset{|}{C}}=S,\ -\overset{|}{\underset{|}{C}}-SH,\ -\overset{|}{\underset{|}{C}}HO_3R,\ -HC=CH,\ -\overset{|}{\underset{|}{C}}-CN \text{ or } -\overset{|}{\underset{|}{C}}-COOR \text{ group}$$

in which R represents a hydrogen atom or an alkali metal cation.

18. A material as claimed in claim 1 in which the silver salt is dispersed in inert gelatine and/or cellulose sulphate.

19. A material as claimed in claim 1 in which the silver salt is dispersed in a cellulose acetate which has up to 2 acetyl groups.

20. A material as claimed in claim 1 in which the light-sensitive layer contains an optical sensitizing dye.

* * * * *